US008005671B2

(12) United States Patent
Rajendran et al.

(10) Patent No.: US 8,005,671 B2
(45) Date of Patent: Aug. 23, 2011

(54) SYSTEMS AND METHODS FOR DYNAMIC NORMALIZATION TO REDUCE LOSS IN PRECISION FOR LOW-LEVEL SIGNALS

(75) Inventors: Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 919 days.

(21) Appl. No.: 11/669,407

(22) Filed: Jan. 31, 2007

(65) Prior Publication Data

US 2008/0130793 A1 Jun. 5, 2008

Related U.S. Application Data

(60) Provisional application No. 60/868,476, filed on Dec. 4, 2006.

(51) Int. Cl.
*G10L 19/00* (2006.01)

(52) U.S. Cl. ..... 704/229; 704/201; 704/221; 704/223; 708/300; 708/495; 708/497

(58) Field of Classification Search ..... 704/201, 704/221, 223, 229; 708/300, 495, 497
See application file for complete search history.

(56) References Cited

U.S. PATENT DOCUMENTS

| | | | | |
|---|---|---|---|---|
| 4,901,307 | A | 2/1990 | Gilhousen et al. | |
| 5,068,899 | A * | 11/1991 | Ellis et al. | 704/212 |
| 5,103,459 | A | 4/1992 | Gilhousen et al. | |
| 5,487,022 | A * | 1/1996 | Simpson et al. | 708/205 |
| 5,570,454 | A * | 10/1996 | Liu | 704/223 |
| 5,699,484 | A * | 12/1997 | Davis | 704/200.1 |
| 5,774,838 | A * | 6/1998 | Miseki et al. | 704/222 |
| 5,915,235 | A | 6/1999 | DeJaco et al. | |
| 6,088,445 | A * | 7/2000 | Chadha et al. | 379/406.08 |
| 6,308,155 | B1 * | 10/2001 | Kingsbury et al. | 704/256.1 |
| 6,456,964 | B2 | 9/2002 | Manjunath et al. | |
| 6,681,202 | B1 * | 1/2004 | Miet et al. | 704/214 |
| 6,711,598 | B1 * | 3/2004 | Pare et al. | 708/300 |
| 6,732,070 | B1 | 5/2004 | Rotola-Pukkila et al. | |
| 7,031,269 | B2 | 4/2006 | Lee | |
| 7,062,525 | B1 * | 6/2006 | Lin | 708/497 |

(Continued)

FOREIGN PATENT DOCUMENTS

EP 1094401 4/2001

(Continued)

OTHER PUBLICATIONS

International Preliminary Report on Patentability—PCT/US07/086076, International Search Authority—European Patent Office, Feb. 13, 2009.

(Continued)

*Primary Examiner* — Daniel D Abebe
(74) *Attorney, Agent, or Firm* — Anthony P. Mauro

(57) ABSTRACT

A normalization factor for a current frame of a signal may be determined. The normalization factor may depend on an amplitude of the current frame of the signal. The normalization factor may also depend on values of states after one or more operations were performed on a previous frame of a normalized signal. The current frame of the signal may be normalized based on the normalization factor that is determined. The states' normalization factor may be adjusted based on the normalization factor that is determined.

20 Claims, 8 Drawing Sheets

U.S. PATENT DOCUMENTS

| | | | | |
|---|---|---|---|---|
| 7,089,184 | B2 * | 8/2006 | Rorex | 704/255 |
| 7,596,492 | B2 | 9/2009 | Sung et al. | |
| 7,657,428 | B2 * | 2/2010 | Haberman et al. | 704/211 |
| 2003/0036901 | A1 | 2/2003 | Chen | |
| 2003/0088405 | A1 * | 5/2003 | Chen et al. | 704/216 |
| 2005/0004793 | A1 | 1/2005 | Ojala et al. | |
| 2008/0126086 | A1 | 5/2008 | Vos et al. | |

FOREIGN PATENT DOCUMENTS

| | | | |
|---|---|---|---|
| EP | 1498873 | A1 | 1/2005 |
| EP | 1515310 | | 3/2005 |
| RU | 2233010 | | 7/2004 |
| WO | WO0156021 | A1 | 8/2001 |

OTHER PUBLICATIONS

Tremain, T. et al., "A 4.8 KBPS Code Excited Linear Predictive Coder," Proceedings of the Mobile Satellite Conference, 1988, pp. 491-496.

European Telecommunications Standards Institute ("ETSI"), Universal Mobile Telecommunications System (UMTS); Mandatory Speech Codec speech processing functions AMR speech codec; Transcoding functions (3G TS 26.090 version 3.1.0 Release 1999), ETSI TS 126 090 V3.1.0 (Jan. 2000), pp. 1-62.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 4, pp. 4-1 to 4-181.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 5, pp. 5-1 to 5-42.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.1 to 4.5, pp. 4-1 to 4-45.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.6 to 4.9.8.4, pp. 4-45 to 4-99.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 4.9.8.5 to 4.16.2, pp. 4-99 to 4-147.

3rd Generation Partnership Project 2 ("3GPP2"), "Enhanced Variable Rate Codec, Speech Service Option 3 and 68 for Wideband Spread Spectrum Digital Systems," 3GPP2 C.S0014-B, Version 1.0, May 2006, ch. 5, pp. 5-1 to 5-32.

Ashley, J.P. and Mittal, U., Closed Loop Dynamic Bit Allocation for Excitation Parameters in Analysis-by-Synthesis Speech Codec, IEEE International Conference on Acoustics, Speech and Signal Processing, 2007 ("ICASSP 2007"), vol. 4, Apr. 15-20, 2007, pp. IV-1109-IV-1112.

Ashley, J.P., et al., "Wideband Coding of Speech Using a Scalable Pulse Codebook," 2000 IEEE Workshop on Speech Coding, 2000, Sep. 17-20, 2000, pp. 148-150.

B.S. Atal and M.R. Schroeder, "Stochastic Coding of Speech Signals at Very Low Bit Rates," Links for the Future; Science, Systems & Services for Communications; Proceedings of the International Conference on Communications ("ICC '84"), May 1984, Part 2, pp. 1610-1613.

Bessette, B., et al., "The Adaptive Multirate Wideband Speech Codec (AMR-WB)," IEEE Transactions on Speech and Audio Processing, vol. 10, No. 8, Nov. 2002, 620-636.

DeJaco, A. et al., "QCELP: The North American CDMA Digital Cellular Variable Rate Speech Coding Standard," IEEE Workshop on Speech Coding for Telecommunications, Oct. 13-15, 1993, pp. 5-6.

Kleijn, W.B. et al., "Fast Methods for the CELP Speech Coding Algorithm," IEEE Transactions on Acoustics, Speech, and Signal Processing [see also IEEE Transactions on Signal Processing], vol. 38, No. 8, Aug. 1990, pp. 1330-1342.

Kleijn, W.B., et al., "The RCELP Speech-Coding Algorithm," European Transaction on Telecommunications and Related Technologies, vol. 5, No. 5, Sep.-Oct. 1994, pp. 573-582.

Kubin, G. et al., "Performance of Noise Excitation for Unvoiced Speech," IEEE Workshop on Speech Coding for Telecommunications, Oct. 13-15, 1993, pp. 35-36.

Laflamme, C., et al., "16 kbps Wideband Speech Coding Technique Based on Algebraic CELP," 1991 International Conference on Acoustics, Speech, and Signal Processing, 1991 ("ICASSP-91"), vol. 1, Apr. 14-17, 1991, pp. 13-16.

Nahumi, D. and Kleijn, W.B., "An Improved 8 KB/S RCELP Coder," 1995 IEEE Workshop on Speech Coding for Telecommunications, Sep. 20-22, 1995, pp. 39-40.

Rabiner, L.R. et al., "Digital Processing of Speech Signals," Prentice Hall, Inc., Englewood, N.J., ch. 8, "Linear Predictive Coding of Speech," 1978, pp. 396-455.

Salami, R., et al., A Toll Quality 8kb/s Speech Codec for the Personal Communications system (PCS), IEEE Transactions on Vehicular Technology, vol. 43, No. 3, Part 1-2, Aug. 1994, 808-816.

Schroeder, M., et al., "Code-excited linear prediction (CELP): High-quality speech at very low bit rates," IEEE International Conference on Acoustics, Speech, and Signal Processing ("ICASSP '85"), vol. 10, Apr. 1985, pp. 937-940.

So, S., et al., "A Comparative Study of LPC Parameter Representations and Quantisation Schemes for Wideband Speech Coding," Digital Signal Processing 17, 2007 (Available online Nov. 8, 2005), pp. 114-137.

Yasukawa, H., "Restoration of Wide Band Signal from Telephone Speech Using Linear Prediction Error Processing," Fourth International Conference on Spoken Language ("ICSLP 96"), vol. 2, Oct. 3-6, 1996, pp. 901-904.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 0.3, Jul. 2006, §§ 4.5, 4.18.3, 5.2.3.15, 5.13, pp. 4-35 to 4-37; 4-163 to 4-165; 5-14; 5-39 to 5-40.

International Search Report—PCT/US07/086076—International Search Authority, European Patent Office—Jul. 8, 2008.

Written Opinion—PCT/US07/086076—International Search Authority, European Patent Office—Jul. 8, 2008.

Chakraborty M., et al. "An efficient block floating point implementation of the LMS algorithm," 2003 IEEE International Conference on Acoustics, Speech, and Signal Processing, Hong Kong, vol. 6, Apr. 6, 2003, pp. VI_80.

Oppenheim A.V., "Realization of digital filters using block-floating-point arithmetic," IEEE Transactions on Audio and Electroacoustics, col. AU-18, No. 2, Jun. 1, 1970, pp. 130-136.

Sridharan S., et al., "Block floating-point implementation of digital filters using the DSP56000," Microprocessors and microsystems, IPC Business Press Ltd., London, GB, vol. 12, No. 6 Jul. 1, 1988, pp. 299-308.

* cited by examiner

SYSTEMS AND METHODS FOR DYNAMIC NORMALIZATION TO REDUCE LOSS IN PRECISION FOR LOW-LEVEL SIGNALS

CLAIM OF PRIORITY UNDER 35 U.S.C. §119

This present Application for Patent claims priority to Provisional Application No. 60/868,476 entitled "DYNAMIC NORMALIZATION TO REDUCE LOSS IN PRECISION FOR LOW-LEVEL SIGNALS" filed Dec. 4, 2006, and assigned to the assignee hereof and hereby expressly incorporated by reference herein.

TECHNICAL FIELD

The present disclosure relates generally to signal processing technology. More specifically, the present disclosure relates to systems and methods for dynamic normalization to reduce loss in precision for low-level signals.

BACKGROUND

The term signal processing may refer to the processing and interpretation of signals. Signals of interest may include sound, images, and many others. Processing of such signals may include storage and reconstruction, separation of information from noise, compression, and feature extraction. The term digital signal processing may refer to the study of signals in a digital representation and the processing methods of these signals. Digital signal processing is an element of many communications technologies such as mobile phones and the Internet. The algorithms that are utilized for digital signal processing may be performed using specialized computers, which may make use of specialized microprocessors called digital signal processors (sometimes abbreviated as DSPs).

SUMMARY

An apparatus that is configured for dynamic normalization to reduce loss in precision for low-level signals is disclosed. The apparatus may include a processor and memory in electronic communication with the processor. Instructions may be stored in the memory. The instructions may be executable to determine a normalization factor for a current frame of a signal. The normalization factor may depend on an amplitude of the current frame of the signal. The normalization factor may also depend on values of states after one or more operations were performed on a previous frame of a normalized signal. The instructions may also be executable to normalize the current frame of the signal based on the normalization factor that is determined. The instructions may also be executable to adjust the states' normalization factor based on the normalization factor that is determined.

A method for dynamic normalization to reduce loss in precision for low-level signals is disclosed. The method may involve determining a normalization factor for a current frame of a signal. The normalization factor may depend on an amplitude of the current frame of the signal. The normalization factor may also depend on values of states after one or more operations were performed on a previous frame of a normalized signal. The method may also involve normalizing the current frame of the signal based on the normalization factor that is determined. The method may also involve adjusting the states' normalization factor based on the normalization factor that is determined.

An apparatus that is configured for dynamic normalization to reduce loss in precision for low-level signals is disclosed. The apparatus may include means for determining a normalization factor for a current frame of a signal. The normalization factor may depend on an amplitude of the current frame of the signal. The normalization factor may also depend on values of states after one or more operations were performed on a previous frame of a normalized signal. The apparatus may also include means for normalizing the current frame of the signal based on the normalization factor that is determined. The apparatus may also include means for adjusting the states' normalization factor based on the normalization factor that is determined.

A computer-readable medium is also disclosed. The computer-readable medium may be configured to store a set of instructions. The set of instructions may be executable to determine a normalization factor for a current frame of a signal. The normalization factor may depend on an amplitude of the current frame of the signal. The normalization factor may also depend on values of states after one or more operations were performed on a previous frame of a normalized signal. The set of instructions may also be executable to normalize the current frame of the signal based on the normalization factor that is determined. The set of instructions may also be executable to adjust the states' normalization factor based on the normalization factor that is determined.

A system for dynamic normalization to reduce loss in precision for low-level signals is also disclosed. The system may include a factor determination component. The factor determination component may be configured to determine a normalization factor for a current frame of a signal. The normalization factor may depend on an amplitude of the current frame of the signal. The normalization factor may also depend on values of states after one or more operations were performed on a previous frame of a normalized signal. The system may also include a signal normalizer. The signal normalizer may be configured to normalize the current frame of the signal based on the normalization factor that is determined. The system may also include a states normalization factor adjuster. The states normalization factor adjuster may be configured to adjust the states' normalization factor based on the normalization factor that is determined.

DETAILED DESCRIPTION

As used herein, the term "determining" (and grammatical variants thereof) is used in an extremely broad sense. The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

Figure 1:
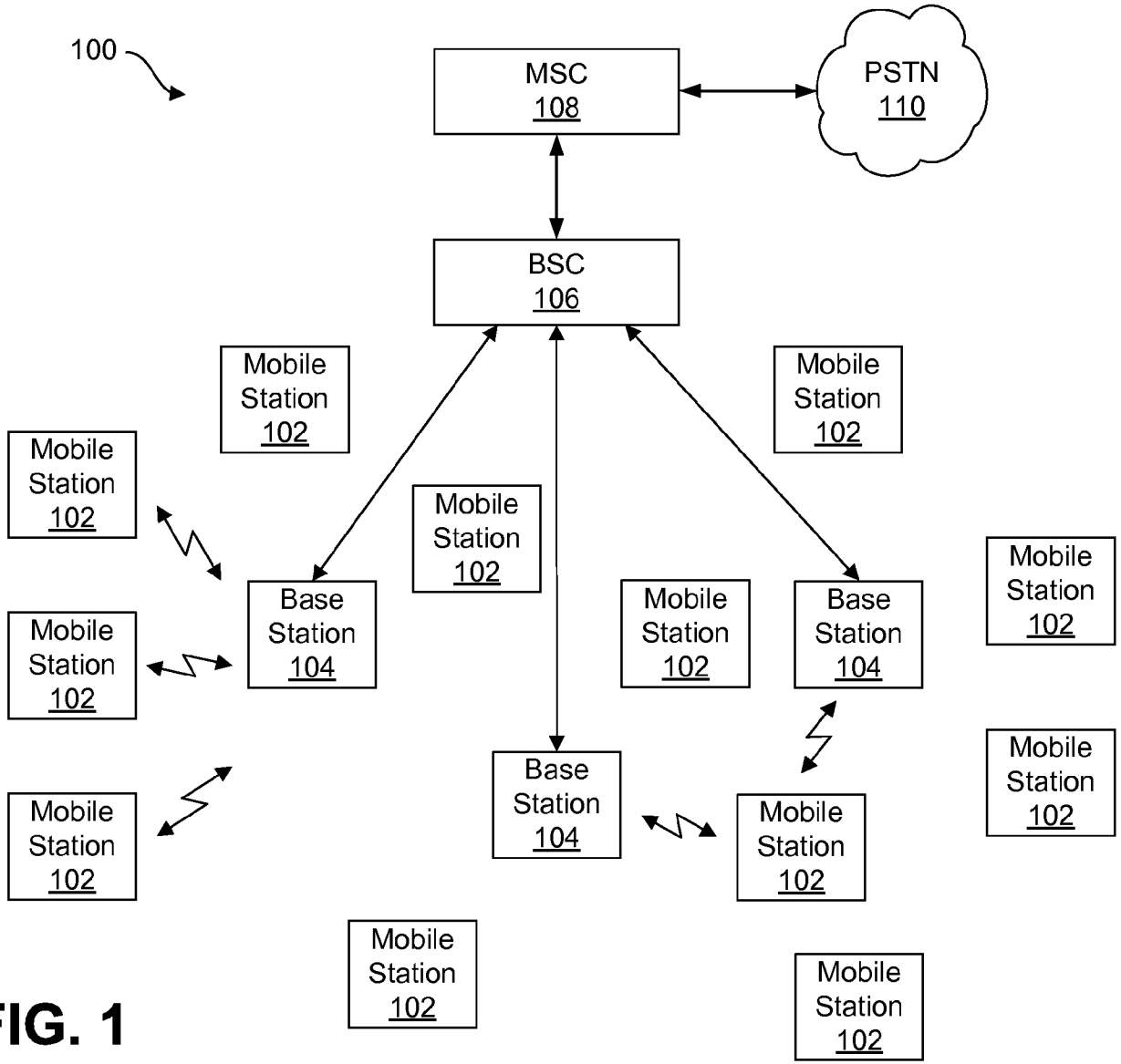
FIG. 1 illustrates a wireless communication system.

FIG. 1 illustrates a wireless communication system 100 that may include a plurality of mobile stations 102, a plurality of base stations 104, a base station controller (BSC) 106 and a mobile switching center (MSC) 108. The MSC 108 may be configured to interface with a public switched telephone network (PSTN) 110. The MSC 108 may also be configured to interface with the BSC 106. There may be more than one BSC 106 in the system 100. The mobile stations 102 may include cellular or portable communication system (PCS) telephones.

Each base station 104 may include at least one sector (not shown), where each sector may have an omnidirectional antenna or an antenna pointed in a particular direction radially away from the base station 104. Alternatively, each sector may include two antennas for diversity reception. Each base station 104 may be designed to support a plurality of frequency assignments. The wireless communication system 100 may be configured to implement code-division multiple access (CDMA) techniques. In a CDMA system 100, the intersection of a sector and a frequency assignment may be referred to as a CDMA channel.

During operation of the wireless communication system 100, the base stations 104 may receive sets of reverse link signals from sets of mobile stations 102. The mobile stations 102 may be conducting telephone calls or other communications. Each reverse link signal received by a given base station 104 may be processed within that base station 104. The resulting data may be forwarded to the BSC 106. The BSC 106 may provide call resource allocation and mobility management functionality including the orchestration of soft handoffs between base stations 104. The BSC 106 may also route the received data to the MSC 108, which may provide additional routing services for interfacing with the PSTN 110. Similarly, the PSTN 110 may interface with the MSC 108, and the MSC 108 may interface with the BSC 106, which in turn may control the base stations 104 to transmit sets of forward link signals to sets of mobile stations 102.

For purposes of example, certain systems and methods will be described in relation to speech signals that may be processed by a wideband vocoder. (The term "wideband vocoder" will be discussed in greater detail below.) However, the systems and methods disclosed herein are applicable outside the context of speech signals. In fact, the systems and methods disclosed herein may be used in connection with the processing of any type of signal (e.g., music, video, etc.) in finite precision.

The discussion that follows includes references to filter states. However, the systems and methods disclosed herein are applicable to other types of states. Also, the term "states" should be construed broadly to mean any configuration of information or memories in a program or machine.

Transmission of voice by digital techniques has become widespread, particularly in long distance and digital radio telephone applications. In the past, voice communications have been limited in bandwidth to the frequency range of 300-3400 kHz. New networks for voice communications, such as cellular telephony and voice over IP, may not have the same bandwidth limits, and it may be desirable to transmit and receive voice communications that include a wideband frequency range over such networks.

A voice coder, or "vocoder," is a device that facilitates the transmission of compressed speech signals across a communication channel. A vocoder may comprise an encoder and a decoder. An incoming speech signal may be divided into blocks of time, or analysis frames. The encoder may analyze an incoming speech frame to extract certain relevant parameters, and then quantize the parameters into a binary representation. The binary representation may be packed into transmission frames and transmitted over a communication channel to a receiver with a decoder. The decoder may process the transmission frames, dequantize them to produce the parameters, and resynthesize the speech frames using the dequantized parameters. The encoding and decoding of speech signals may be performed by digital signal processors (DSPs) running a vocoder. Because of the nature of some voice communication applications, the encoding and decoding of speech signals may be done in real time.

A device (e.g., a mobile station 102 or a base station 104) that is deployed in a wireless communication system 100 may include a wideband vocoder, i.e., a vocoder that is configured to support a wideband frequency range. A wideband vocoder may comprise a wideband encoder and a wideband decoder.

Figure 2:
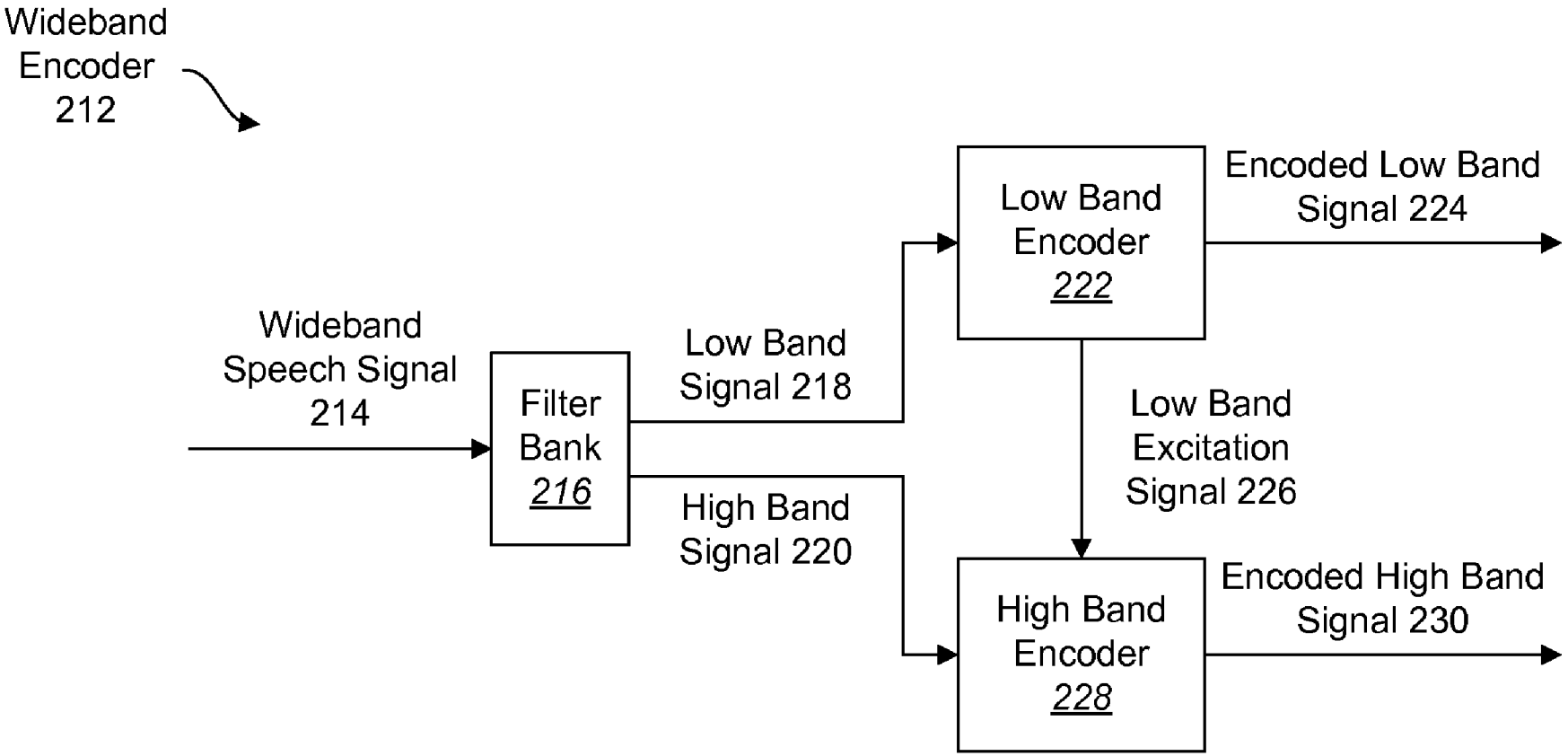
FIG. 2 illustrates a wideband encoder that may be utilized in a wireless communication system.

FIG. 2 illustrates a wideband encoder 212. The wideband encoder 212 may be implemented in an apparatus that may be utilized within a wireless communication system 100. The apparatus may be a mobile phone, a personal digital assistant (PDA), a laptop computer, a digital camera, a music player, a game device, or any other device with a processor. The apparatus may function as a mobile station 102 or a base station 104 within a wireless communication system 100.

A wideband speech signal 214 may be provided to the wideband encoder 212. The wideband encoder 212 may include an analysis filter bank 216. The filter bank 216 may filter the wideband speech signal 214 to produce a low band signal 218 and a high band signal 220.

The low band signal 218 may be provided to a low band encoder 222. The low band encoder 222 may encode the low band signal 218, thereby generating an encoded low band signal 224. The low band encoder 222 may also output a low band excitation signal 226.

The high band signal 220 may be provided to a high band encoder 228. The low band excitation signal 226 that is output by the low band encoder 222 may also be provided to the high band encoder 228. The high band encoder 228 may encode the high band signal 220 according to information in the low band excitation signal 226, thereby generating an encoded high band signal 230.

Figure 3:
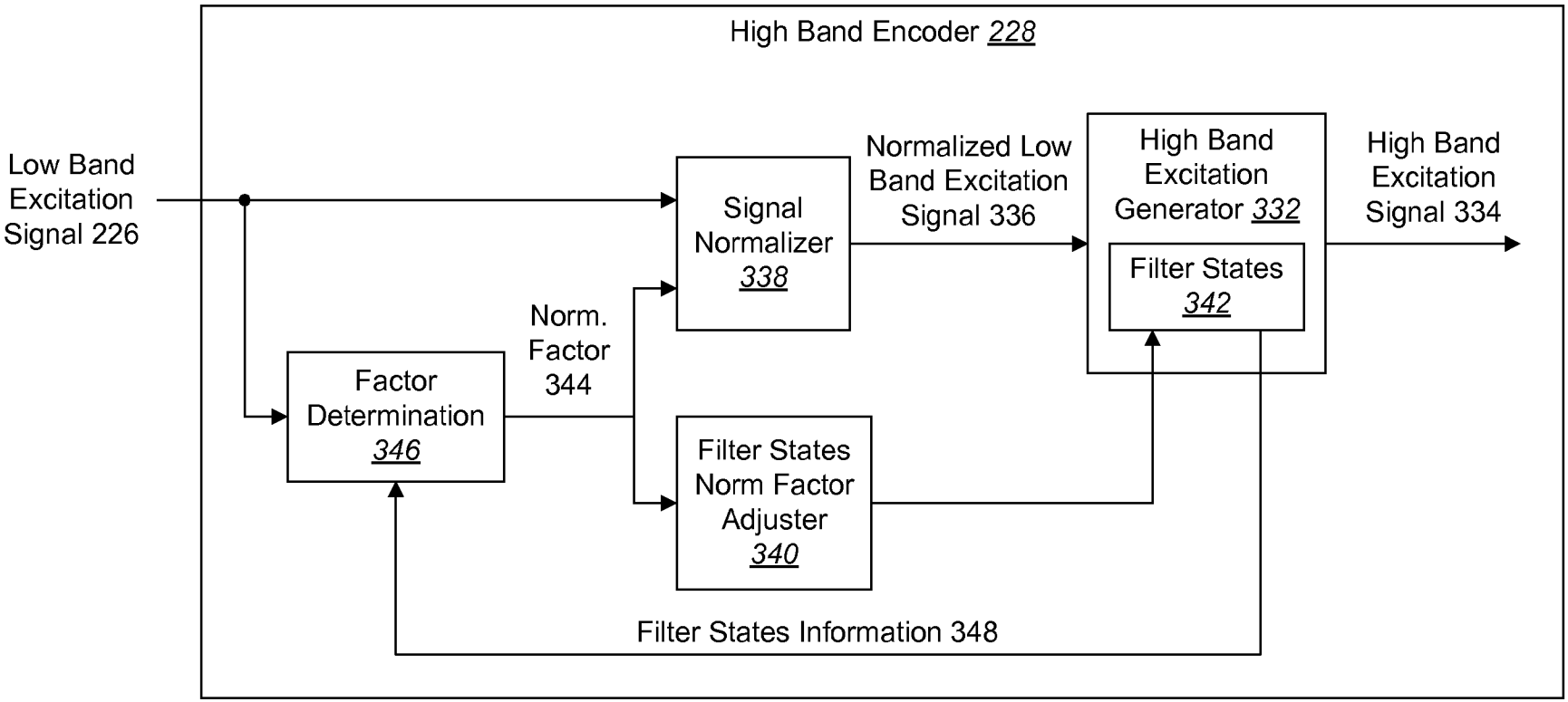
FIG. 3 illustrates a high band encoder from the wideband encoder of FIG. 2.

FIG. 3 illustrates the high band encoder 228. As discussed above, the low band excitation signal 226 may be provided to the high band encoder 228. The high band encoder 228 may include a high band excitation generator 332. The high band excitation generator 332 may derive a high band excitation signal 334 from the low band excitation signal 226.

A finite number of bits is available to represent the amplitude of the signals within the wideband encoder 212, such as the incoming wideband speech signal 214 and the low band excitation signal 226. The precision with which these signals may be represented may be directly proportional to the number of bits that are used to represent them. The term "amplitude," as used herein, may refer to any amplitude value of an array of amplitude values. For example, the term "amplitude" may refer to the maximum of the absolute values of the elements of an array of amplitude values.

The high band excitation generator 332 may perform a number of arithmetic operations on the low band excitation signal 226 (or, as will be explained below, a normalized version 336 of the low band excitation signal 226) in order to generate the high band excitation signal 334. In performing at least some of these arithmetic operations on the low band excitation signal 226, the high band excitation generator 332 may utilize the N most significant bits (MSBs) within the low band excitation signal 226. In other words, if M bits are used to represent the amplitude of the low band excitation signal 226, the high band excitation generator 332 may discard the M-N least significant bits (LSBs) within the low band excitation signal 226 and may utilize the N MSBs of the low band excitation signal 226 for the arithmetic operations that are performed.

Human speech may be classified in many different ways. Some classifications of speech may include voiced speech, unvoiced sounds, transient speech, and silence intervals/background noise during pauses between words. Under certain circumstances (e.g., for unvoiced sounds, transient speech, and silence intervals/background noise), the amplitude of the wideband speech signal 214 may be relatively low. The term low-level signal may be used herein to refer to a wideband speech signal 214 that has a relatively low amplitude. Where the incoming wideband speech signal 214 is a low-level signal, the amplitude of the low band excitation signal 226 may be fully represented, or at least mostly represented, within the LSBs of the available bits. If the LSBs are discarded by the high band excitation generator 332, then there may be a significant loss in the precision with which the low band excitation signal 226 is represented. In an extreme case, the low band excitation signal 226 may be approximated to zero by the high band excitation generator 332.

To address this issue and potentially reduce the loss of precision, the high band encoder 228 may include a signal normalizer 338. The signal normalizer 338 may normalize the low band excitation signal 226, thereby obtaining the normalized low band excitation signal 336. Additional details about the operation of the signal normalizer 338 in normalizing the low band excitation signal 226 will be discussed below.

The low band excitation signal 226 may be normalized based on a normalization factor 344. The normalization factor 344 may alternatively be referred to as a Q factor 344. The normalization factor 344 may be selected so as to prevent saturation, as will be discussed below. The component that determines the normalization factor 344 may be referred to as a factor determination component 346.

The low band excitation signal 226 may be divided into a number of frames. The term "current frame" may refer to the frame that is presently being processed by the wideband encoder 212. The term "previous frame" may refer to the frame of the low band excitation signal 226 that was processed immediately prior to the current frame.

Normalization may be performed on a frame-by-frame basis. Thus, different normalization factors 344 may be determined for different frames of the low band excitation signal 226. Because the normalization factor 344 may change over time, the type of normalization that may be performed by the signal normalizer 338 and the filter states normalization factor adjuster 340 may be referred to as dynamic normalization.

Once the normalization factor 344 for the current frame of the low band excitation signal 226 has been determined, the signal normalizer 338 may normalize the current frame of the low band excitation signal 226 based on the normalization factor 344. Normalizing the low band excitation signal 226 may comprise left-shifting the bits of the low band excitation signal 226 by an amount that corresponds to the normalization factor 344.

In some implementations, the normalization factor 344 may be negative. For example, once the normalization factor 344 is initially determined, an amount (e.g., 1) may be subtracted from the initial value of the normalization factor 344 as a protection to prevent saturation. This may be referred to as providing "head room." Where the normalization factor 344 is negative, left-shifting by a negative normalization factor 344 may be the same as right-shifting by the corresponding positive number.

Additionally, a filter states normalization factor adjuster 340 may be provided. The filter states normalization factor adjuster 340 may adjust the normalization factor of the filter states 342 based on the normalization factor 344 that is determined. Adjusting the normalization factor of the filter states 342 may comprise left-shifting the bits of the filter states 342 by an amount that corresponds to the difference between the normalization factor 344 that is determined for the current frame of the low band excitation signal 226 and the normalization factor 344 that was determined for the previous frame of the low band excitation signal 226. This operation brings the filter states 342 into the same normalization factor 344 as the normalized low band excitation signal 336, which may facilitate filtering operations being performed.

When the normalization factor 344 has been determined, the current frame of the low band excitation signal 226 has been normalized, and the normalization factor of the filter states 342 of the high band excitation generator 332 has been adjusted, the high band excitation generator 332 may derive the high band excitation signal 334 from the normalized low band excitation signal 336. This may involve performing filtering operations on the normalized low band excitation signal 336 using the adjusted filter states 342, both of which have a normalization factor 344.

The normalization factor 344 for the current frame of the low band excitation signal 226 may be selected so that saturation does not occur. There may be several ways that saturation may occur. For example, saturation may occur by left-shifting the bits of the low band excitation signal 226 to an extent where the low band excitation signal falls out of range, the range given by the number of bits used to represent the low band excitation signal. In the example discussed above, it was assumed that M bits are used to represent the low band excitation signal 226. In this case, the maximum value of the low band excitation signal 226 using 2's complement signed arithmetic may be $2^{(M-1)}-1$ and the minimum value may be $-2^{M}$. If M=16 (i.e., if 16 bits are used to represent the low band excitation signal 226), the maximum value of the low band excitation signal 226 using 2's complement signed arithmetic may be $2^{15}-1$, or 32767 and the minimum value may be $-2^{15}$, or −32768. In this situation, saturation may occur if the bits of the low band excitation signal 226 are left-shifted so that the value of the low band excitation signal 226 exceeds 32767 (for positive numbers) or becomes less than −32768 (for negative numbers). The normalization factor 344 may be determined so that this type of saturation does not occur. Thus, the normalization factor 344 may depend on the amplitude of the current frame of the low band excitation signal 226. Accordingly, the current frame of the low band excitation signal 226 may be provided to the factor determination component 346 and used to determine the normalization factor 344.

As another example, saturation may occur by left-shifting the bits of the filter states 342 of the high band excitation generator 332 to an extent where the filter states fall out of range. As discussed in the example above, if M=16, this range is given by the set of numbers which fall into the category of numbers no greater than +32767 and no less than −32768. The normalization factor 344 may be determined so that this does not occur. When the normalization factor of the filter states 342 is adjusted, the values of the filter states 342 may depend on the filtering operations that were performed on the previous frame of the normalized low band excitation signal 336. Thus, the normalization factor 344 may depend on the values of the filter states 342 after the filtering operations were performed on the previous frame of the normalized low band excitation signal 336. Accordingly, information 348 about the values of the filter states 342 after the filtering operations were performed on the previous frame of the normalized low band excitation signal 336 may be provided to the factor determination component 346 and used to determine the normalization factor 344.

Each frame of the low band excitation signal 226 may be normalized in the manner described above. More specifically, for each frame of the low band excitation signal 226, a normalization factor 344 may be determined. The current frame of the low band excitation signal 226 may be normalized based on the normalization factor 344 that is determined for that frame. Also, the normalization factor of the filter states 342 may be adjusted based on the normalization factor 344 that is determined for that frame. These steps (i.e., determining the normalization factor 344, normalizing the current frame of the low band excitation signal 226, and adjusting the normalization factor of the filter states 342) may be performed for each frame of the low band excitation signal 226.

Figure 4:
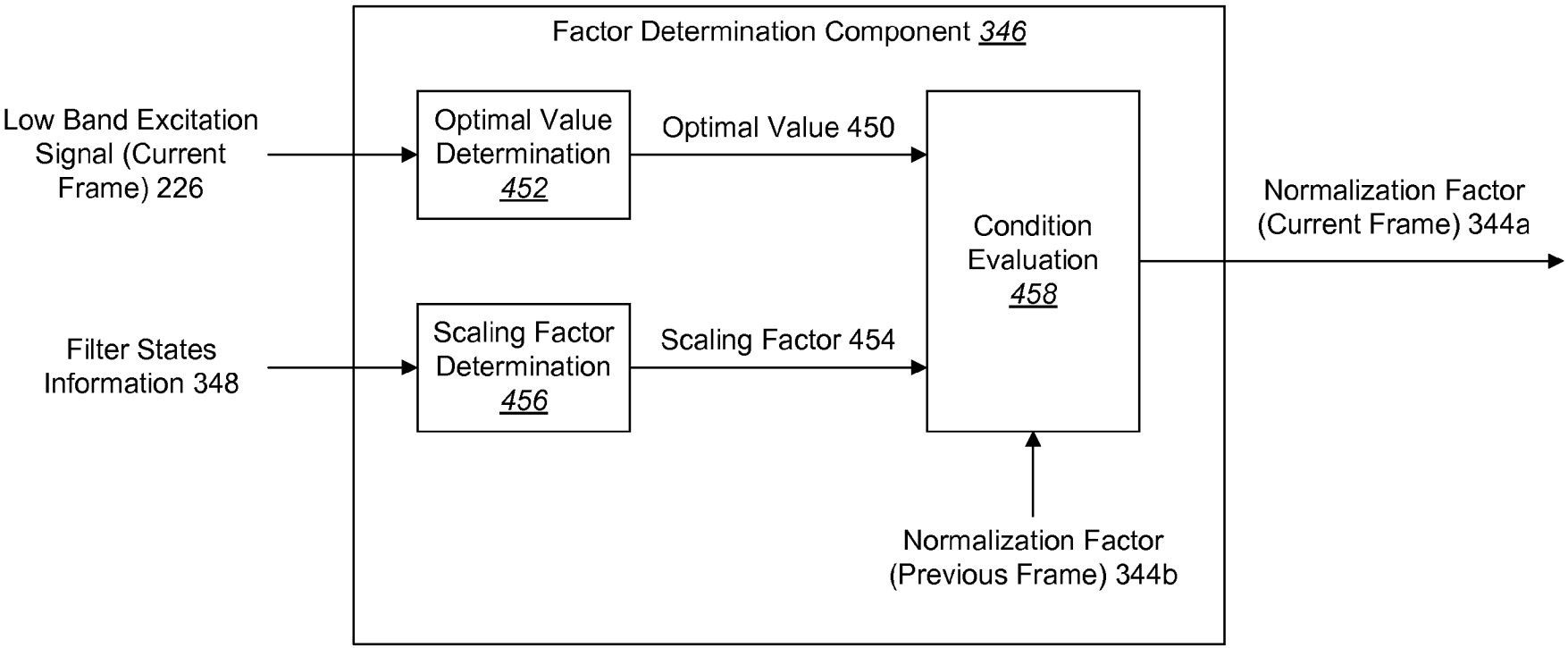
FIG. 4 illustrates a factor determination component from the high band encoder of FIG. 3.

FIG. 4 illustrates the factor determination component 346. As discussed above, the factor determination component 346 may determine the normalization factor 344*a* for the current frame of the low band excitation signal 226.

As discussed above, the current frame of the low band excitation signal 226 may be provided to the factor determination component 346. The current frame of the low band excitation signal 226 may be analyzed to determine an optimal value for the normalization factor 344*a* for the current frame of the low band excitation signal 226. (The optimal value is labeled with reference number 450 in FIG. 4, and will be referred to as optimal value 450 hereinafter.) The component that implements this functionality may be referred to as an optimal value determination component 452.

The optimal value 450 for the normalization factor 344 may be determined based on the amplitude of the current frame of the low band excitation signal 226. Since the low band excitation signal 226 of the current frame comprises an array of numbers, the optimal value 450 of the normalization factor 344 may refer to the number of bits of the maximum of the absolute value of the array of numbers that can be left-shifted without causing saturation, also referred to as the block normalization factor. The optimal value 450 for the normalization factor 344 may indicate to what extent the bits of the current frame of the low band excitation signal 226 may be left-shifted without causing saturation.

As discussed above, information 348 about the values of the filter states 342 after the filtering operations were performed on the previous frame of the normalized low band excitation signal 336 may also be provided to the factor determination component 346. This information 348 may be used to determine a scaling factor 454 for the filter states 342 of the high band excitation generator 332. The component that implements this functionality may be referred to as a scaling factor determination component 456.

The scaling factor 454 may be determined based on the filter states information 348 that is received. The scaling factor 454 may indicate to what extent the bits of the filter states 342 may be left-shifted without causing saturation. The procedure for obtaining this scaling factor 454 may be similar to the above-mentioned procedure of determining the optimal value 450 for the normalization factor 344, the array of numbers in this case being the filter states, where the filter states may be states from different filters.

In some implementations, some filter states may be double precision (DP, 32 bits) and some filter states may be single precision (SP, 16 bits). In such implementations, the block normalization factor of the double precision filter states may be obtained. This block normalization factor may then be scaled down by a factor of two to bring it to the single precision domain. It may then be determined which is the lowest block normalization factor between this scaled down double precision block normalization factor and the block normalization factor of the single precision filter states. The lowest block normalization factor may then be outputted as the scaling factor 454. In this specific example the terms current frame normalization factor 344*a* and previous frame normalization factor 344*b* refer to the normalization factor in the single precision domain. The filter states normalization factor adjuster 340 scales up by a factor of two the difference between the normalization factor 344 that is determined for the current frame of the low band excitation signal 226 and the normalization factor 344 that was determined for the previous frame of the low band excitation signal 226, before left-shifting the bits of the double precision filter states 342.

A saturation condition may be evaluated. The component that implements this functionality may be referred to as a condition evaluation component 458. The saturation condition may depend on the optimal value 450 for the normalization factor 344*a* for the current frame of the low band excitation signal 226. The saturation condition may also depend on the scaling factor 454 for the filter states 342 of the high band excitation generator 332.

The saturation condition may also depend on the normalization factor 344*b* for the previous frame of the low band excitation signal 226. The normalization factor 344*b* for the previous frame of the low band excitation signal 226 may indicate to what extent the bits of the previous frame of the low band excitation signal 226 were shifted prior to filtering operations being performed on the previous frame of the normalized low band excitation signal 336.

The saturation condition that is evaluated may be expressed as:

$$Qinp-prev_Qinp>Q_\text{states} \quad (1)$$

In equation (1), the term Qinp may refer to the optimal value 450 for the normalization factor 344*a* for the current frame of the low band excitation signal 226. The term prev_Qinp may refer to the normalization factor 344*b* for the previous frame of the low band excitation signal 226. The term Q_states may refer to the scaling factor 454 for the filter states 342.

If it is determined that the saturation condition is not satisfied, this may be interpreted to mean that setting the normalization factor 344*a* equal to the optimal value 450 that was determined is not going to cause saturation. In this case, determining the normalization factor 344*a* for the current frame of the low band excitation signal 226 may involve setting the normalization factor 344*a* equal to the optimal value 450 that was determined.

If it is determined that the saturation condition is satisfied, this may be interpreted to mean that setting the normalization factor 344*a* equal to the optimal value 450 that was determined is going to cause saturation. In this case, determining the normalization factor 344*a* for the current frame of the low band excitation signal 226 may involve setting the normalization factor 344*a* equal to prev_Qinp+Q_states. In this expression, the terms Qinp, prev_Qinp and Q_states may have the same meaning as was discussed above in connection with equation (1). Hence, the normalization factor 344*a* may be given by the expression MIN (Q_inp, prev_Qinp+Q_states).

Figure 5:
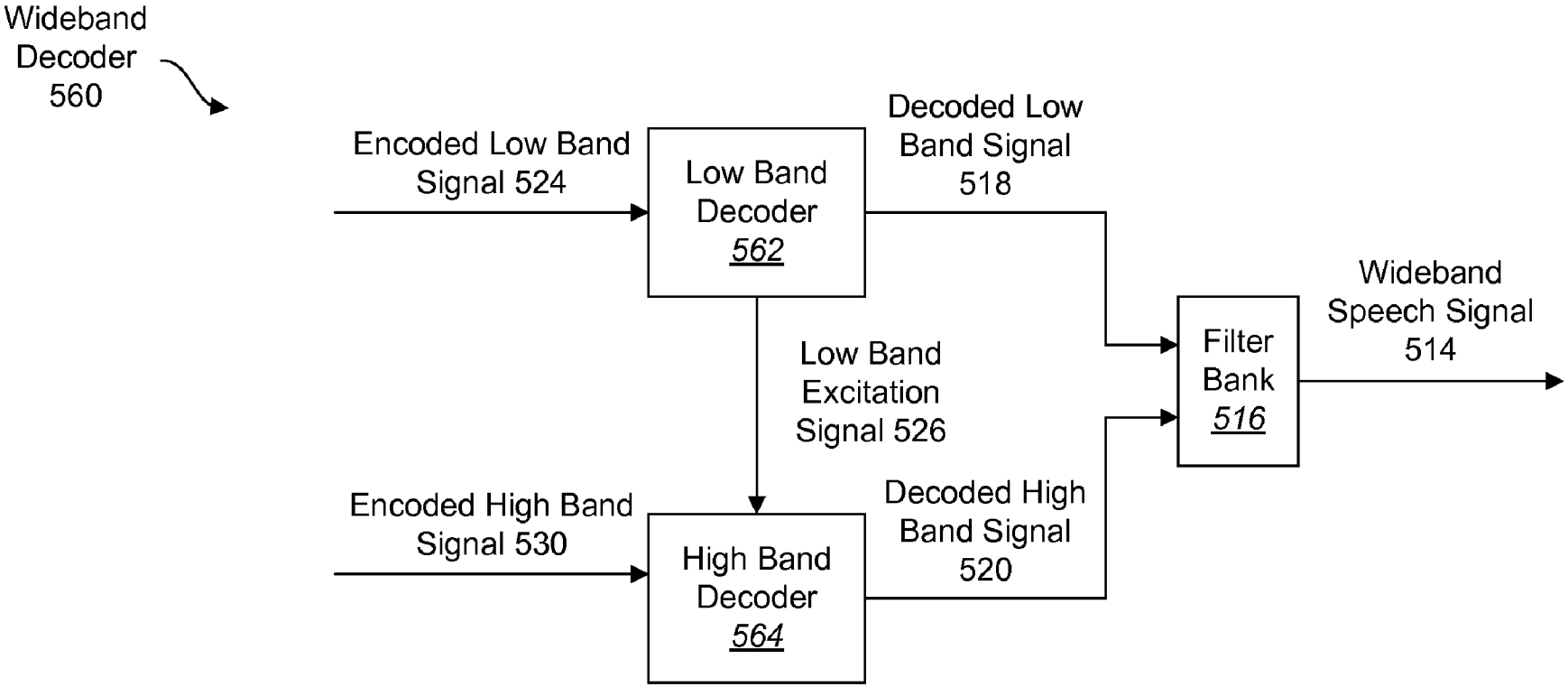
FIG. 5 illustrates a wideband decoder that may be utilized in a wireless communication system.

FIG. 5 illustrates a wideband decoder 560. The wideband decoder 560 may be implemented in an apparatus that may be utilized within a wireless communication system 100. The apparatus may be a mobile phone, a personal digital assistant (PDA), a laptop computer, a digital camera, a music player, a game device, or any other device with a processor. The apparatus may function as a mobile station 102 or a base station 104 within a wireless communication system 100.

An encoded low band signal 524 (or 224) may be provided to the wideband decoder 560. The wideband decoder 560 may include a low band decoder 562. The low band decoder 562 may decode the encoded low band signal 524, thereby obtaining a decoded low band signal 518. The low band decoder 562 may also output a low band excitation signal 526.

An encoded high band signal 530 (or 230) may also be provided to the wideband decoder 560. The wideband decoder 560 may include a high band decoder 564. The encoded high band signal 530 may be provided to the high band decoder 564. The low band excitation signal 526 that is output by the low band decoder 562 may also be provided to the high band decoder 564. The high band decoder 564 may decode the encoded high band signal 530 according to information in the low band excitation signal 526, thereby obtaining a decoded high band signal 520.

The wideband decoder 560 may also include a synthesis filter bank 516. The decoded low band signal 518 that is output by the low band decoder 562 and the decoded high band signal 520 that is output by the high band decoder 564 may be provided to the synthesis filter bank 516. The synthesis filter bank 516 may combine the decoded low band signal 518 and the decoded high band signal 520 to produce a wideband speech signal 514.

The high band decoder 564 may include some of the identical components that were described above in connection with the high band encoder 228. For example, the high band decoder 564 may include the high band excitation generator 332, the signal normalizer 338, the filter states normalization factor adjuster 340, and the factor determination component 346. (These components are not shown in FIG. 5.) The operation of these components may be similar or identical to the operation of the corresponding components that were described above in relation to the high band encoder 228. Thus, the techniques described above for dynamic normalization of the low band excitation signal 226 in the context of a wideband encoder 212 may also be applied to the low band excitation signal 526 that is shown in FIG. 5 in the context of a wideband decoder 560.

Figure 6:
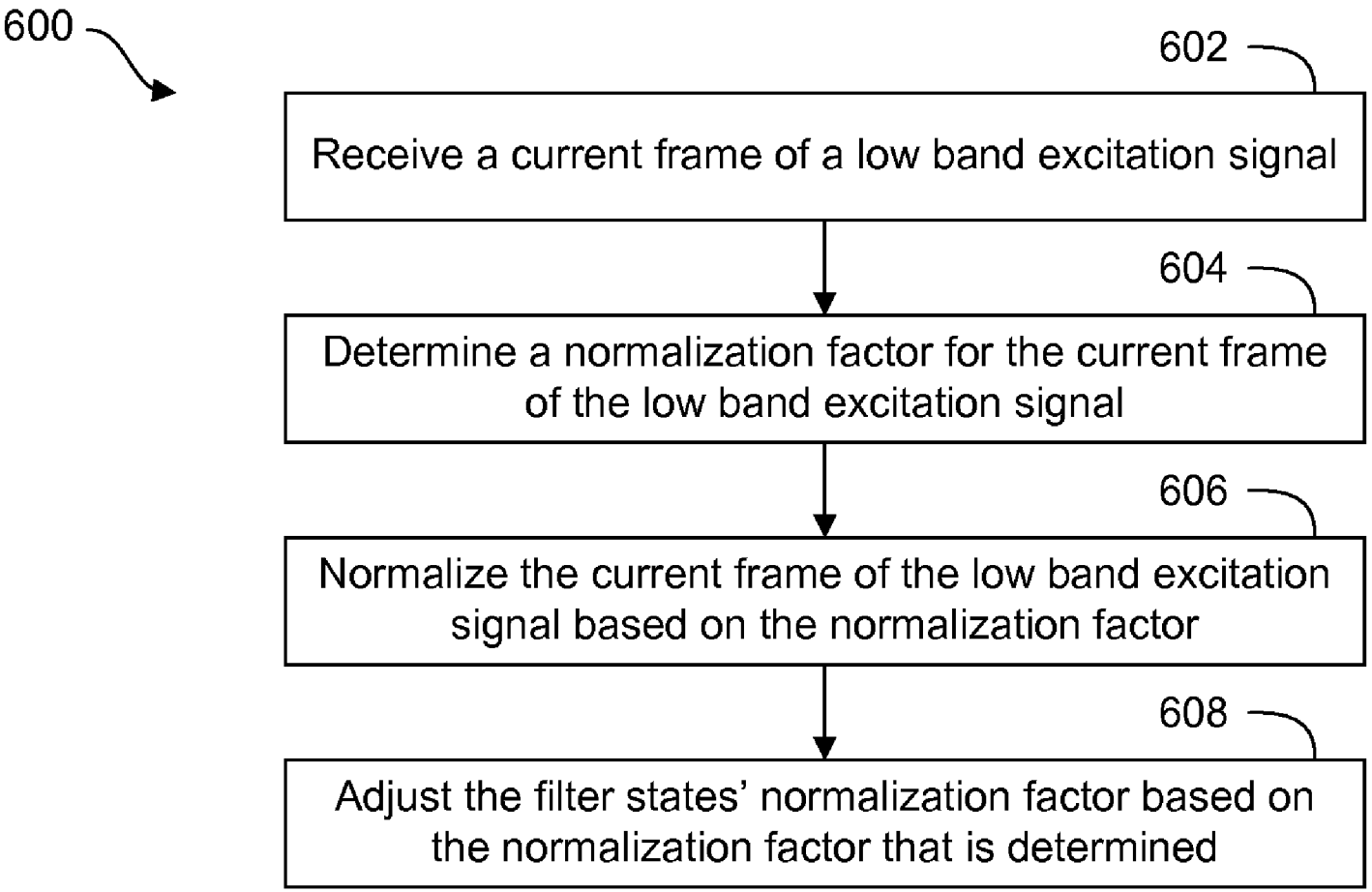
FIG. 6 illustrates a method for dynamic normalization to reduce loss in precision for low-level signals.

FIG. 6 illustrates a method 600 for dynamic normalization to reduce loss in precision for low-level signals. The method 600 may be implemented by a wideband encoder 212 within a mobile station 102 or a base station 104 within a wireless communication system 100. Alternatively, the method 600 may be implemented by a wideband decoder 560 within a mobile station 102 or a base station 104 within a wireless communication system 100.

In accordance with the method 600, a current frame of a low band excitation signal 226 may be received 602. A normalization factor 344 for the current frame of the low band excitation signal 226 may be determined 604. The normalization factor 344 may depend on the amplitude of the current frame of the low band excitation signal 226. The normalization factor 344 may also depend on the values of filter states 342 of a high band excitation generator 332 after filtering operations were performed on a previous frame of a normalized low band excitation signal 336.

The current frame of the low band excitation signal 226 may be normalized 606 based on the normalization factor 344 that is determined 604. In addition, the normalization factor of the filter states of the high band excitation generator 332 may be adjusted 608 based on the normalization factor 344 that is determined 604.

Figure 7:
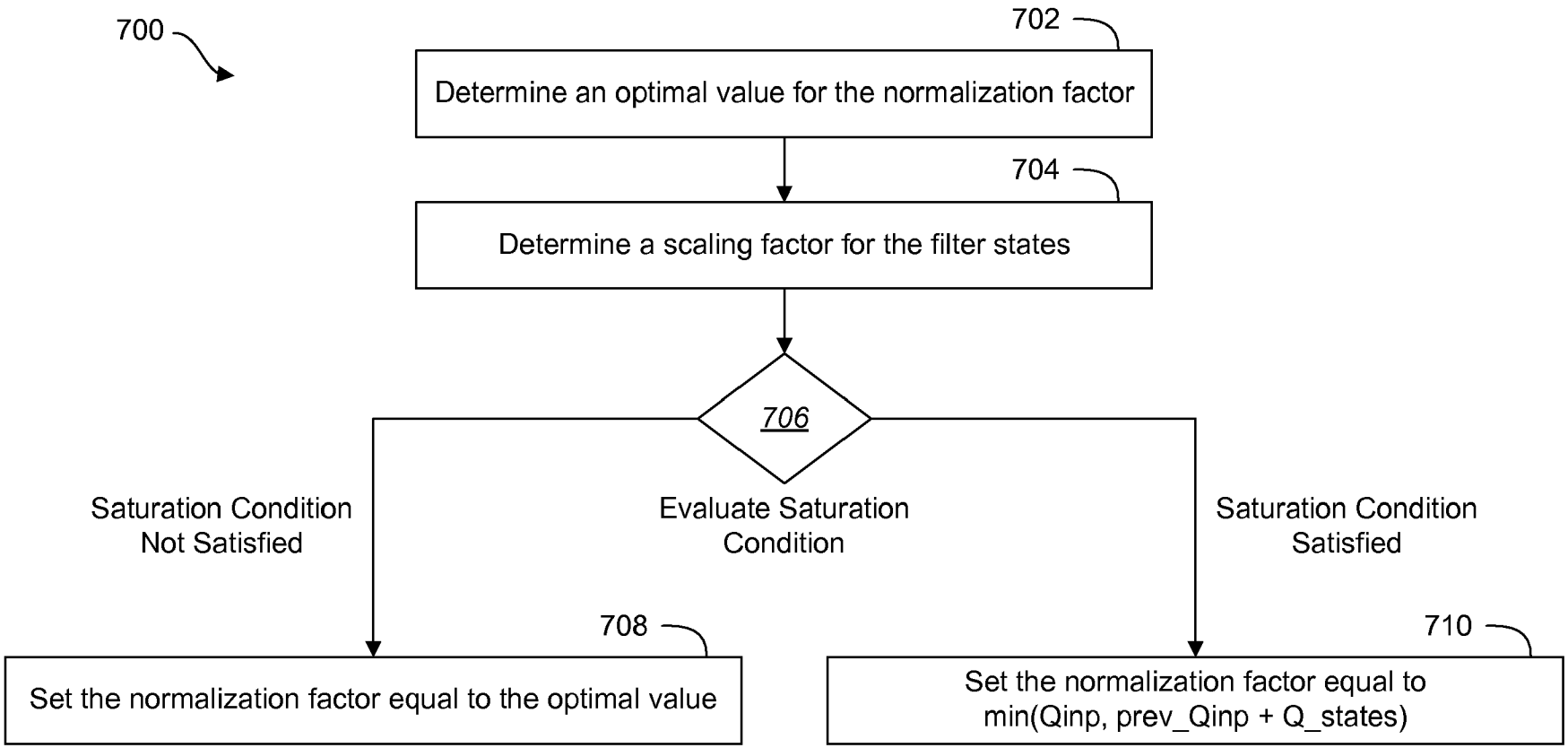
FIG. 7 illustrates a method for determining a normalization factor for a current frame of a low band excitation signal.

FIG. 7 illustrates a method 700 for determining a normalization factor 344*a* for the current frame of the low band excitation signal 226. (The reference number 344*a* refers to the normalization factor 344*a* for the current frame, and the reference number 344*b* refers to the normalization factor 344*b* for the previous frame.) The method 700 may be implemented by a wideband encoder 212 within a mobile station 102 or a base station 104 within a wireless communication system 100. Alternatively, the method 700 may be implemented by a wideband decoder 560 within a mobile station 102 or a base station 104 within a wireless communication system 100.

In accordance with the method 700, an optimal value 450 for the normalization factor 344*a* for the current frame of the low band excitation signal 226 may be determined 702. The optimal value 450 for the normalization factor 344*a* may indicate to what extent the bits of the current frame of the low band excitation signal 226 may be left-shifted without causing saturation.

A scaling factor 454 for the filter states 342 of the high band excitation generator 332 may be determined 704. The scaling factor 454 may indicate to what extent the bits of the filter states 342 may be left-shifted without causing saturation.

A saturation condition may be evaluated 706. The saturation condition may depend on the optimal value 450 for the normalization factor 344*a* for the current frame of the low band excitation signal 226. The saturation condition may also depend on the scaling factor 454 for the filter states 342 of the high band excitation generator 332. The saturation condition may also depend on the normalization factor 344*b* for the previous frame of the low band excitation signal 226.

If it is determined 706 that the saturation condition is not satisfied, this may be interpreted to mean that setting the normalization factor 344 equal to the optimal value 450 that was determined 702 is not going to cause saturation. Accordingly, the normalization factor 344 for the current frame of the low band excitation signal 226 may be set 708 equal to the optimal value 450 that was determined 702.

If it is determined 706 that the saturation condition is satisfied, this may be interpreted to mean that setting the normalization factor 344 equal to the optimal value 450 that was determined 702 is going to cause saturation. Accordingly, the normalization factor 344*a* for the current frame of the low band excitation signal 226 may be set 710 equal to prev_Qinp+Q_states. As discussed above, the term prev_Qinp may refer to the normalization factor 344*b* for the previous frame of the low band excitation signal 226. The term Q_states may refer to the scaling factor for the filter states 342.

Figure 8:
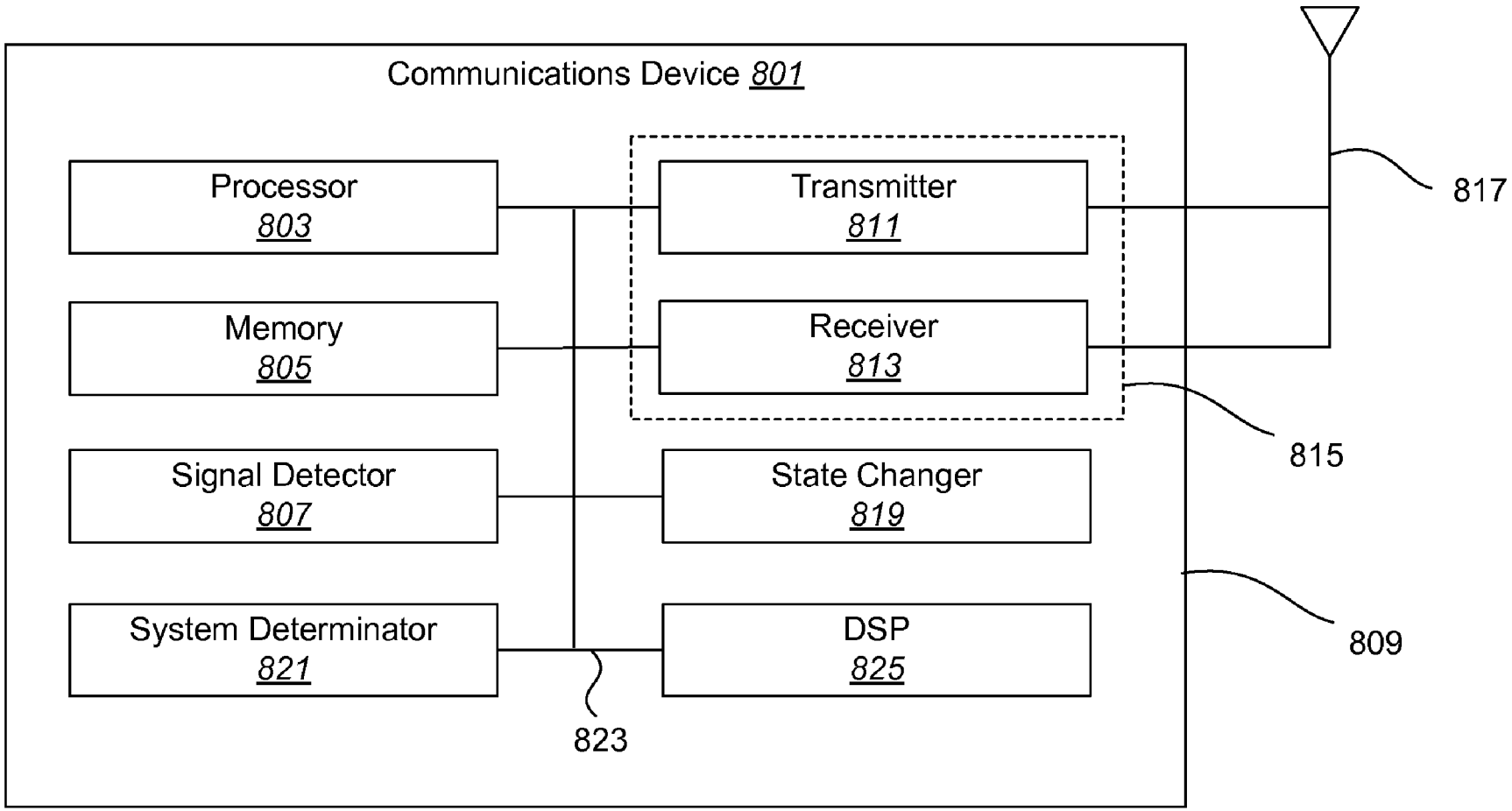
FIG. 8 illustrates various components that may be utilized in a communications device.

FIG. 8 illustrates various components that may be utilized in a communications device 801. The communications device 801 may include a processor 803 which controls operation of the device 801. The processor 803 may also be referred to as a CPU. Memory 805, which may include both read-only memory (ROM) and random access memory (RAM), provides instructions and data to the processor 803. A portion of the memory 805 may also include non-volatile random access memory (NVRAM).

The communications device 801 may also include a housing 809 that may include a transmitter 811 and a receiver 813 to allow transmission and reception of data between the communications device 801 and a remote location. The transmitter 811 and receiver 813 may be combined into a transceiver 815. An antenna 817 may be attached to the housing 809 and electrically coupled to the transceiver 815.

The communications device 801 may also include a signal detector 807 that may be used to detect and quantify the level of signals received by the transceiver 815. The signal detector 807 may detect such signals as total energy, pilot energy per pseudonoise (PN) chips, power spectral density, and other signals.

A state changer 819 of the communications device 801 may control the state of the communications device 801 based on a current state and additional signals received by the transceiver 815 and detected by the signal detector 807. The device 801 may be capable of operating in any one of a number of states. The communications device 801 may also include a system determinator 821 that may be used to control the device 801 and to determine which service provider system the device 801 should transfer to when it determines the current service provider system is inadequate.

The various components of the communications device 801 may be coupled together by a bus system 823 which may include a power bus, a control signal bus, and a status signal bus in addition to a data bus. However, for the sake of clarity, the various busses are illustrated in FIG. 8 as the bus system 823. The communications device 801 may also include a digital signal processor (DSP) 825 for use in processing signals.

Information and signals may be represented using any of a variety of different technologies and techniques. For example, data, instructions, commands, information, signals and the like that may be referenced throughout the above description may be represented by voltages, currents, electromagnetic waves, magnetic fields or particles, optical fields or particles or any combination thereof The various illustrative logical blocks, modules, circuits, methods, and algorithm steps disclosed herein may be implemented in hardware, software, or both. To clearly illustrate this interchangeability of hardware and software, various illustrative components, blocks, modules, circuits and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as limiting the scope of the claims.

The various illustrative logical blocks, modules and circuits described above may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be a controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The methods disclosed herein may be implemented in hardware, in software, or both. Software may reside in any form of storage medium that is known in the art. Some examples of storage media that may be used include RAM memory, flash memory, ROM memory, EPROM memory, EEPROM memory, registers, a hard disk, a removable disk, an optical disk, and so forth. Software may comprise a single instruction, or many instructions, and may be distributed over several different code segments, among different programs and across multiple storage media. A storage medium may be coupled to a processor such that the processor can read information from, and write information to, the storage medium. In the alternative, the storage medium may be integral to the processor.

The methods disclosed herein may comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

While specific features, aspects, and configurations have been illustrated and described, it is to be understood that the claims are not limited to the precise configuration and components illustrated above. Various modifications, changes, and variations may be made in the arrangement, operation and details of the features, aspects, and configurations described above without departing from the scope of the claims.

What is claimed is:

1. An apparatus that is configured for dynamic normalization to reduce loss in precision for low-level signals, comprising:

a processor;

memory in electronic communication with the processor; and instructions stored in the memory, the instructions being executable to:

determine a normalization factor for a current frame of a signal, wherein the current frame comprises M bits, wherein the M bits comprise N most significant bits and M-N least significant bits, wherein the M-N least significant bits of the current frame are discarded, wherein the normalization factor depends on an amplitude of the current frame of the signal, and wherein the normalization factor also depends on values of filter states of a high band excitation generator after one or more operations were performed on a previous frame of a normalized low band excitation signal;

normalize the current frame of the signal based on the normalization factor that is determined, wherein the normalized current frame utilizes more of the N most significant bits than the current frame; and adjust the filter states' normalization factor based on the normalization factor that is determined.

2. The apparatus of claim 1, wherein the normalization factor is selected so that saturation does not occur.

3. The apparatus of claim 1, wherein determining the normalization factor for the current frame of the signal comprises:

determining an optimal value for the current frame's normalization factor based on the amplitude of the current frame of the signal;

determining a scaling factor for the filter states based on information about the values of the filter states after the one or more operations were performed on the previous frame of the normalized low band excitation signal; and evaluating a saturation condition that depends on the optimal value for the current frame's normalization factor, the scaling factor, and the normalization factor for the previous frame of the signal.

4. The apparatus of claim 3, wherein the previous frame's normalization factor indicates to what extent bits of the previous frame of the signal were shifted prior to the one or more operations being performed on the previous frame of the normalized low band excitation signal.

5. The apparatus of claim 3, wherein the optimal value for the current frame's normalization factor indicates a number of bits of the current frame of the signal that are left-shifted before causing saturation.

6. The apparatus of claim 3, wherein the scaling factor for the filter states indicates a number of bits of the filter states that are left-shifted before causing saturation.

7. The apparatus of claim 3, wherein the saturation condition is expressed as Qinp−prev_Qinp>Q_states, wherein Qinp is the optimal value for the current frame's normalization factor, wherein prev_Qinp is the previous frame's normalization factor, and wherein Q_states is the scaling factor for the filter states.

8. The apparatus of claim 3, wherein if the saturation condition is satisfied, determining the current frame's normalization factor further comprises setting the current frame's normalization factor to prev_Qinp+Q_states, wherein Qinp is the optimal value for the current frame's normalization factor, wherein prev_Qinp is the previous frame's normalization factor, and wherein Q_states is the scaling factor for the filter states.

9. The apparatus of claim 3, wherein if the saturation condition is not satisfied, determining the current frame's normalization factor further comprises setting the current frame's normalization factor to the optimal value for the current frame's normalization factor.

10. The apparatus of claim 1, wherein normalizing the current frame of the signal comprises left-shifting bits of the current frame of the signal by an amount that corresponds to the current frame's normalization factor.

11. The apparatus of claim 1, wherein adjusting the filter states comprises shifting bits of the filter states by an amount that corresponds to a difference between the current frame's normalization factor and the previous frame's normalization factor.

12. The apparatus of claim 1, wherein determining the current frame's normalization factor, normalizing the current frame of the signal, and adjusting the filter states are performed for each frame of the signal.

13. The apparatus of claim 1, wherein the signal is a low band excitation signal, and wherein the high band excitation generator derives a high band excitation signal from the normalized low band excitation signal.

14. The apparatus of claim 13, wherein deriving the high band excitation signal from the normalized low band excitation signal comprises performing filtering operations on the current frame of the normalized low band excitation signal using normalized filter states.

15. The apparatus of claim 13, wherein the high band excitation generator does not use least significant bits from the normalized low band excitation signal to derive the high band excitation signal.

16. The apparatus of claim 1, wherein the apparatus is selected from a mobile station and a base station.

17. The apparatus of claim 1, wherein the instructions are comprised within an implementation of a component that is selected from a wideband encoder and a wideband decoder.

18. A method for dynamic normalization to reduce loss in precision for low-level signals, comprising:

determining a normalization factor for a current frame of a signal, wherein the current frame comprises M bits, wherein the M bits comprise N most significant bits and M-N least significant bits, wherein the M-N least significant bits of the current frame are discarded, wherein the normalization factor depends on an amplitude of the current frame of the signal, and wherein the normalization factor also depends on values of filter states of a high band excitation generator after one or more operations were performed on a previous frame of a normalized low band excitation signal;

normalizing the current frame of the signal based on the normalization factor that is determined, wherein the normalized current frame utilizes more of the N most significant bits than the current frame; and adjusting the filter states' normalization factor based on the normalization factor that is determined, wherein the determining, the normalizing, and the adjusting are performed by a communications device.

19. An apparatus that is configured for dynamic normalization to reduce loss in precision for low-level signals, comprising:

means for determining a normalization factor for a current frame of a signal, wherein the current frame comprises M bits, wherein the M bits comprise N most significant bits and M-N least significant bits, wherein the M-N least significant bits of the current frame are discarded, wherein the normalization factor depends on an amplitude of the current frame of the signal, and wherein the normalization factor also depends on values of filter states of a high band excitation generator after one or more operations were performed on a previous frame of a normalized low band excitation signal;

means for normalizing the current frame of the signal based on the normalization factor that is determined, wherein the normalized current frame utilizes more of the N most significant bits than the current frame; and means for adjusting the filter states' normalization factor based on the normalization factor that is determined;

wherein the means for determining, the means for normalizing, and the means for adjusting comprise hardware.

20. A non-transitory computer-readable medium comprising a set of instructions executable by a processor to:

determine a normalization factor for a current frame of a signal, wherein the current frame comprises M bits, wherein the M bits comprise N most significant bits and M-N least significant bits, wherein the M-N least significant bits of the current frame are discarded, wherein the normalization factor depends on an amplitude of the current frame of the signal, and wherein the normalization factor also depends on values of filter states of a high band excitation generator after one or more operations were performed on a previous frame of a normalized low band excitation signal;

normalize the current frame of the signal based on the normalization factor that is determined, wherein the normalized current frame utilizes more of the N most significant bits than the current frame; and adjust the filter states' normalization factor based on the normalization factor that is determined.

* * * * *